US007535449B2

(12) United States Patent
Miyazawa

(10) Patent No.: US 7,535,449 B2
(45) Date of Patent: May 19, 2009

(54) METHOD OF DRIVING ELECTRO-OPTICAL DEVICE AND ELECTRONIC APPARATUS

(75) Inventor: Takashi Miyazawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 717 days.

(21) Appl. No.: 10/773,410

(22) Filed: Feb. 9, 2004

(65) Prior Publication Data

US 2004/0201581 A1 Oct. 14, 2004

(30) Foreign Application Priority Data

Feb. 12, 2003 (JP) ..... 2003-033666

(51) Int. Cl.
*G09G 3/36* (2006.01)

(52) U.S. Cl. ..... 345/92; 345/76; 345/83; 345/95; 345/210

(58) Field of Classification Search ..... 345/76–104, 345/204–215, 690–699
See application file for complete search history.

(56) References Cited

U.S. PATENT DOCUMENTS

| | | | | |
|---|---|---|---|---|
| 6,373,454 | B1 * | 4/2002 | Knapp et al. | 345/76 |
| 6,522,315 | B2 | 2/2003 | Ozawa et al. | 345/92 |
| 6,781,567 | B2 | 8/2004 | Kimura | |
| 6,816,144 | B2 * | 11/2004 | Tsuchi | 345/100 |
| 6,858,991 | B2 * | 2/2005 | Miyazawa | 315/169.3 |
| 7,154,454 | B2 | 12/2006 | Okabe et al. | |
| 2003/0006955 | A1 * | 1/2003 | Tsuchi | 345/92 |
| 2004/0239599 | A1 * | 12/2004 | Koyama | 345/76 |

FOREIGN PATENT DOCUMENTS

| | | |
|---|---|---|
| CN | 1347071 A | 5/2002 |
| JP | A-2002-351401 | 12/2002 |
| JP | A-2003-173165 | 6/2003 |
| JP | A 2003/177709 | 6/2003 |
| JP | A 2004-054188 | 2/2004 |
| JP | A 2006-011470 | 1/2006 |
| JP | A 2006-039574 | 2/2006 |

OTHER PUBLICATIONS

R. M. A. Dawson et al; "4.2: Design of an Improved Pixel for a Polysilicon Active-Matrix Organic LED Display"; SID 98 Digest; 1998; pp. 11-14.

* cited by examiner

*Primary Examiner*—Vijay Shankar
(74) *Attorney, Agent, or Firm*—Oliff & Berridge, PLC

(57) ABSTRACT

The invention provides a method of driving an electro-optical device and an electronic apparatus which are capable of reducing the time for writing data without providing special circuits. In the electro-optical device pixel circuits having reset transistors for controlling an electric connection between drains and gates of driving transistors between the drains and the gates of the driving transistors are arranged on a display panel in a matrix. The pixel circuits arranged in a matrix are electrically connected to a scanning line driving circuit via scanning lines. The scanning line driving circuit sequentially switches on the reset transistors from the pixel circuit connected to first scanning lines in accordance with scanning line control signals supplied from a control circuit and then lets organic EL elements emit light.

15 Claims, 9 Drawing Sheets

METHOD OF DRIVING ELECTRO-OPTICAL DEVICE AND ELECTRONIC APPARATUS

BACKGROUND OF THE INVENTION

1. Field of Invention

The present invention relates to a method of driving an electro-optical device and an electronic apparatus.

2. Description of Related Art

One method of driving a display device using organic EL elements as electro-optical elements can include an active matrix driving method in which a plurality of pixel circuits for controlling the brightness of respective organic electroluminescent (EL) elements are arranged in a matrix. Each of the pixel circuits includes a transistor for controlling the driving current supplied to the organic EL element and a storage capacitor for storing voltage corresponding to a data voltage for controlling the electrical connection state of the transistor. Further, the pixel circuits are electrically connected to a scanning line driving circuit, via scanning lines corresponding thereto, and the pixel circuits are electrically connected to a data line driving circuit via data lines corresponding thereto. The scanning line driving circuit selects the pixel circuits via the scanning lines, and supplies data signals from the data line driving circuit via the data lines to the respective selected pixel circuits.

Therefore, the data signals are written in the storage capacitors provided in the pixel circuits. Also, voltages having magnitudes corresponding to the magnitudes of the written data signals are stored in the storage capacitors. The electrical connection states of the transistors are controlled in accordance with the values of the voltages stored in the storage capacitors. The transistors generate driving currents corresponding to the electrical connection states. The driving currents to the organic EL elements (see, for example, Pamphlet of International Laid-open No. WO98/36407) are supplied so as to control the brightness of the organic EL elements.

SUMMARY OF THE INVENTION

The smaller data signals are, the longer a period of time for writing the data signals in the storage capacitors (hereinafter, referred to as writing time) is. In particular, when it is desired to emit light from the organic EL elements at low brightness, the time for writing the data signals in the storage capacitors is longer due to the wiring capacitance of the data lines and the like, thereby causing delay in displaying images. Accordingly, an object of the present invention is to provide a method of driving an electro-optical device and an electronic apparatus, which are capable of reducing the time for writing data without providing special circuits.

The present invention provides a method of driving an electro-optical device having scanning lines, data lines, and pixel circuits having electro-optical elements. The method can include a first step of electrically connecting either sources or drains of driving transistors to controlling terminals of the driving transistors and using the electric potential of the controlling terminals as a first electric potential in a state where an electric connection between the electro-optical elements and the driving transistors connected to the electro-optical elements is intercepted, a second step of supplying selection signals for switching on switching transistors of the pixel circuits via the scanning lines, applying data voltages corresponding to data to capacitor elements connected to the controlling terminals via the data lines and the switching transistors during a period of time in which the switching transistors are switched on by the selection signals, and setting the electrical connection state of the driving transistors using the electric potential of the controlling terminals as a second electric potential by capacitive coupling, and a third step of supplying power in accordance with the electrical connection state of the driving transistors to the electro-optical elements. At least the switching transistors are not switched on during a period of time in which the first step is performed.

According to the above method, the controlling terminals of the driving transistors are electrically connected to the drains or sources thereof before writing data. The electric potential of the controlling terminals of the driving transistors is forced to increase up to the threshold voltage of the driving transistors so that the driving transistors are reset. Accordingly, it is possible to provide an electro-optical device capable of reducing the time for writing data without providing special circuits for resetting the pixel circuits.

In the above method of driving an electro-optical device, preferably, the first electric potential may be a potential for switching off the driving transistors. According to the above method, it is possible to simplify the structures of the reset pixel circuits while compensating for the threshold voltage of the driving transistors.

The present invention also provides a method of driving an electro-optical device having scanning lines, data lines, and pixel circuits having electro-optical elements. The method can include a first step of electrically connecting either sources or drains of driving transistors to controlling terminals of the driving transistors and using the electric potential of the controlling terminals as a first electric potential in a state where an electric connection between the electro-optical elements and the driving transistors connected to the electro-optical elements is intercepted, a second step of supplying selection signals for switching on switching transistors of the pixel circuits via the scanning lines, applying data voltages corresponding to data to capacitor elements connected to the controlling terminals via the data lines and the switching transistors during a period of time in which the switching transistors are switched on by the selection signals, and setting the electrical connection state of the driving transistors using the electric potential of the controlling terminals as a second electric potential by capacitive coupling, and a third step of supplying power in accordance with the electrical connection state of the driving transistors to the electro-optical elements. The scanning lines to which the selection signals for switching on the switching transistors are supplied are not adjacent to the scanning lines to which the selection signals next to the corresponding selection signals for switching on the switching transistors are supplied.

According to the above method, it is possible to control the electro-optical device capable of reducing the time for writing data using a transfer scanning method without providing special circuits for resetting the pixel circuits. As a result, since it is possible to let each scanning line reset the pixel circuits and control the writing of data, it is possible to reduce the burden of the scanning line driving circuit for supplying data signals to the pixel circuits.

The present invention also provides a method of driving an electro-optical device comprising scanning lines, data lines, and pixel circuits having electro-optical elements. The method can include a first step of electrically connecting either sources or drains of driving transistors to controlling terminals of the driving transistors and using the electric potential of the controlling terminals as a first electric potential in a state where an electric connection between the electro-optical elements and the driving transistors connected to the electro-optical elements is intercepted, a second step of supplying selection signals for switching on switching transistors of the pixel circuits via the scanning lines, applying data voltages corresponding to data to capacitor elements connected to the controlling terminals via the data lines and the switching transistors during a period of time in which the switching transistors are switched on by the selection signals, and setting the electrical connection state of the driving transistors using the electric potential of the controlling terminals as a second electric potential by capacitive coupling, and a third step of supplying power in accordance with the electrical connection state of the driving transistors to the electro-optical elements. A main period of time defined by selecting all of the scanning lines includes: a first sub-period of time for performing the second and third steps for the pixel circuits corresponding to the odd scanning lines, among the scanning lines; and a second sub-period of time for performing the second and third steps for the pixel circuits corresponding to the even scanning lines among the scanning lines.

According to the above method, it is possible to control the electro-optical device capable of reducing the time for writing data using an interlace method, without providing special circuits for resetting the pixel circuits. As a result, since it is possible to let each scanning line reset the pixel circuits and control the writing of data, it is possible to reduce the burden of the scanning line driving circuit for supplying the data signals to the pixel circuits.

In the above method of driving an electro-optical device, preferably, the supply of power to the electro-optical elements included in the corresponding pixel circuits is stopped by performing the first step for the pixel circuits corresponding to the even scanning lines among the scanning lines in the first sub-period of time, and the supply of power to the electro-optical elements included in the corresponding pixel circuits is stopped by performing the first step for the pixel circuits corresponding to the odd scanning lines among the scanning lines in the second sub-period of time.

According to the above method, it is possible to control the electro-optical device using the interlace method by ceasing to supply power to the electro-optical elements of the pixel circuits corresponding to the odd scanning lines among the scanning lines in the first sub-period and by ceasing to supply power to the electro-optical elements of the pixel circuits corresponding to the odd scanning lines among the scanning lines in the second sub-period.

The present invention can also provide a method of driving an electro-optical device having scanning lines, data lines, electro-optical elements, and pixel circuits, each pixel circuit having a first transistor with a first terminal, a second terminal, and a first controlling terminal, which are connected to the corresponding electro-optical element. The method can include a first step of setting the electric potential of the first controlling terminal to a first electric potential by applying a predetermined voltage to a fourth terminal of a second transistor having a third terminal, the fourth terminal, and a second controlling terminal, in which the third terminal and the second controlling terminal are connected to the first controlling terminal, a second step of supplying selection signals for switching on switching transistors of the pixel circuits via the scanning lines, applying data voltages corresponding to data to capacitor elements connected to the first controlling terminals via the data lines and the switching transistors during a period of time in which the switching transistors are switched on by the selection signals, and setting the electrical connection state of the first transistors using the electric potential of the first controlling terminals as a second electric potential by capacitive coupling, and a third step of supplying power in accordance with the electrical connection state of the first transistors to the electro-optical elements. The at least the switching transistors are not switched on during a period of time in which the first step is performed.

According to the above method, it is possible to provide an electro-optical device capable of reducing the time for writing data without forming special circuits for resetting the pixel circuits.

In the above method of driving an electro-optical device, preferably, the scanning lines to which the selection signals for switching on the switching transistors are supplied are not adjacent to the scanning lines to which the selection signals next to the corresponding selection signals for switching on the switching transistors are supplied.

According to the above method, it is possible to control the electro-optical device capable of reducing the time for writing data using the transfer scanning method, without providing special circuits for resetting the pixel circuits. As a result, since it is possible to let each scanning line reset the pixel circuits and control the writing of data, it is possible to reduce the burden of the scanning line driving circuit for supplying the data signals to the pixel circuits.

In the above method of driving an electro-optical device, preferably, the first electric potential is a potential for switching off the first transistors. According to the above method, it is possible to reset the pixel circuits by controlling the first electric potential.

In the above method of driving an electro-optical device, preferably, a main period of time defined by selecting all of the scanning lines includes a first sub-period of time for performing the second and third steps for the pixel circuits corresponding to the odd scanning lines among the scanning lines, and a second sub-period of time for performing the second and third steps for the pixel circuits corresponding to the even scanning lines among the scanning lines.

According to the above method, it is possible to control the electro-optical device capable of reducing the time for writing data using the interlace method without providing special circuits for resetting the pixel circuits. As a result, since it is possible to let each scanning line reset the pixel circuits and control the writing of data, it is possible to reduce the burden of the scanning line driving circuit for supplying the data signals to the pixel circuits.

In the above method of driving an electro-optical device, preferably, the supply of power to the electro-optical elements included in the corresponding pixel circuits is stopped by performing the first step for the pixel circuits corresponding to the even scanning lines among the scanning lines in the first sub-period of time, and the supply of power to the electro-optical elements included in the corresponding pixel circuits is stopped by performing the first step for the pixel circuits corresponding to the odd scanning lines among the scanning lines in the second sub-period of time. According to above method, it is possible to control the electro-optical device using the interlace method by ceasing to supply power to the electro-optical elements of the pixel circuits corresponding to the odd scanning lines among the scanning lines in the first sub-period of time and by ceasing to supply power to the electro-optical elements of the pixel circuits corresponding to the odd scanning lines among the scanning lines in the second sub-period of time.

In the above method of driving an electro-optical device, the electro-optical elements included in the pixel circuits corresponding to the scanning lines may be luminous elements which emit red, green, or blue light. According to the above method, in a full color electro-optical device, it is possible to reset the pixel circuits without providing special circuits for resetting the pixel circuits.

In the above method of driving an electro-optical device, the electro-optical elements may be organic EL elements whose luminescent layers are made of organic materials. According to the above method, in the electro-optical device using organic EL elements, it is possible to reset the pixel circuits without providing special circuits for resetting the pixel circuits.

The present invention can also provide an electronic apparatus using the method of driving the electro-optical device as mentioned above. According to above method, it is possible to reset the pixel circuits using the driving method without providing special circuits for resetting the pixel circuits and thus reduce the time for writing data. It is also possible to reduce the manufacturing cost of a display device by an amount corresponding to the cost of portions which are not needed to manufacture special circuits for resetting the pixel circuits.

BRIEF DESCRIPTION OF THE DRAWINGS

The invention will be described with reference to the accompanying drawings, wherein like numerals reference like elements, and wherein.

DETAILED DESCRIPTION OF PREFERRED EMBODIMENTS

Figure 1:
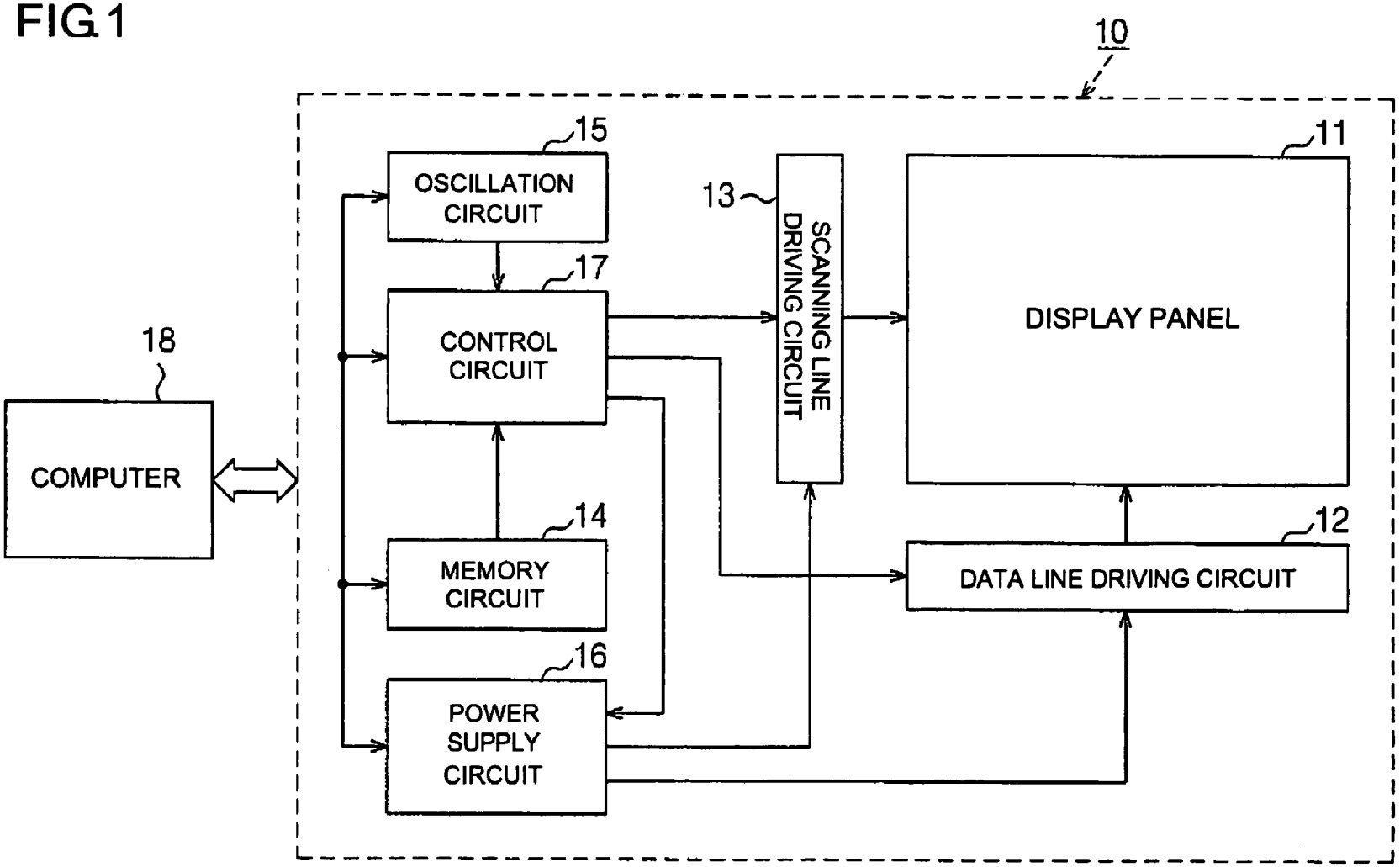
FIG. 1 is an exemplary block circuit diagram illustrating the circuit structure of an organic EL display according to a first embodiment.
Figure 2:
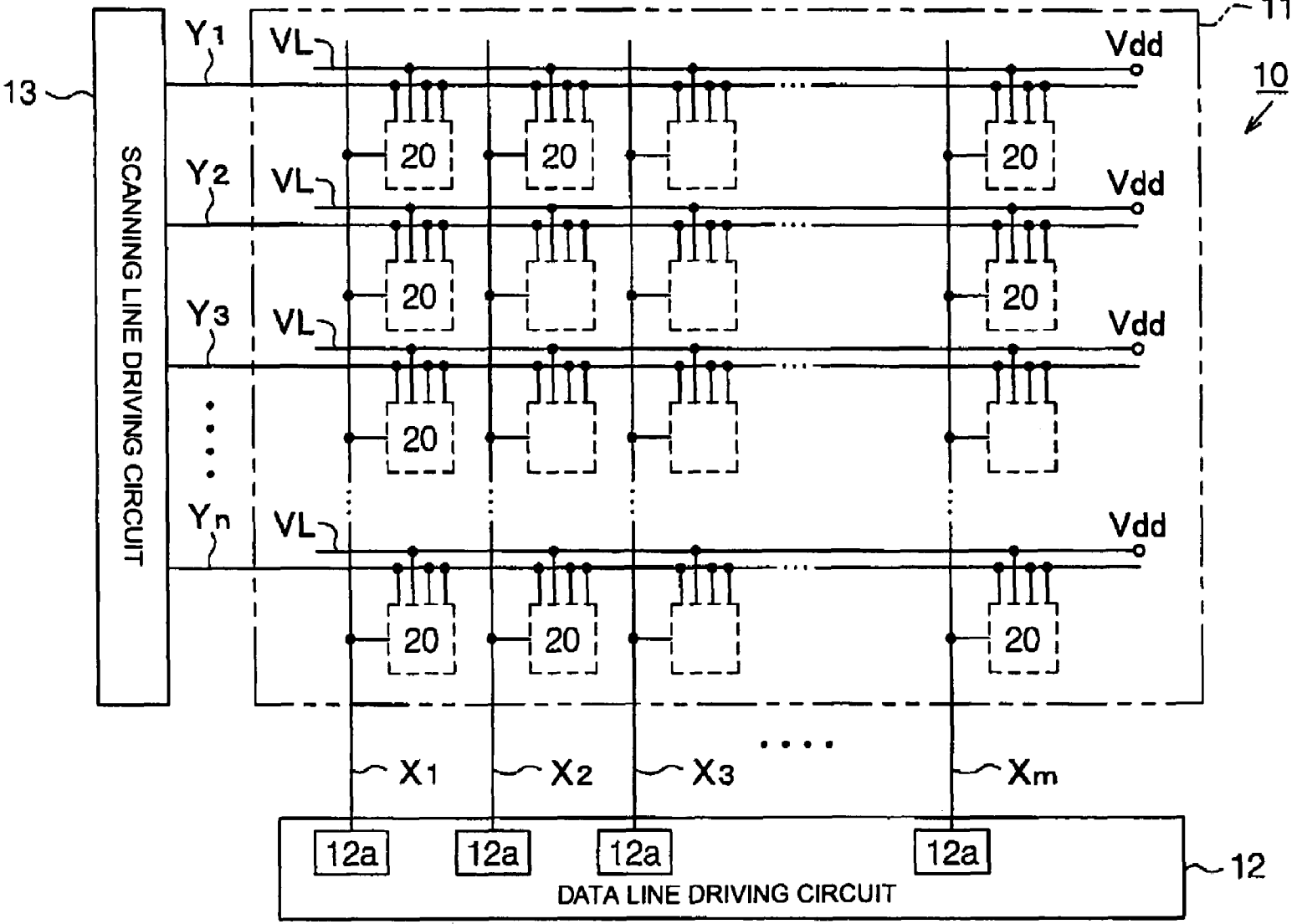
FIG. 2 is an exemplary block circuit diagram illustrating the internal circuit structures of a display panel and a data line driving circuit.

A first embodiment of the present invention will be described with reference to FIGS. 1 to 4. FIG. 1 is an exemplary block circuit diagram illustrating the electrical structure of an organic EL display 10. FIG. 2 is an exemplary block circuit diagram illustrating the electrical structure of a display panel, a data line driving circuit, and a scanning line driving circuit.

In FIG. 1, the organic EL display 10 can include a display panel 11, a data line driving circuit 12, a scanning line driving circuit 13, a memory circuit 14, an oscillation circuit 15, a power supply circuit 16, and a control circuit 17. The respective elements 11 to 17 of the organic EL display 10 may be formed of independent electronic parts. For example, each of the elements 11 to 17 may be formed of a one-chip semiconductor integrated circuit device. Further, all or some of the elements 11 to 17 may be formed of an integrated electronic part. For example, the data line driving circuit 12 and the scanning line driving circuit 13 may be integrally formed in the display panel 11. All or some of the elements 11 to 17 may be formed of programmable IC chips and the functions thereof may be realized by software such as programs written in the IC chips.

As illustrated in FIG. 2, the display panel 11 can include a plurality of pixel circuits 20 arranged in a matrix. The plurality of pixel circuits 20 is respectively connected to m data lines X1 to Xm (m is a natural number) that extend along the column direction thereof and n scanning lines Y1 to Yn (n is a natural number) that extend along the row direction thereof Further, each of the pixel circuits 20 includes an organic EL element 21 (refer to FIG. 3) whose luminescent layer is made of an organic material.

Further, the display panel 11 can include power lines VL that extend parallel to the scanning lines Y1 to Yn. Each of the power lines VL supplies a driving voltage Vdd to a later-mentioned driving transistor Qd (refer to FIG. 3) formed in each of the pixel circuits 20 formed along the power lines VL.

As illustrated in FIGS. 1 and 2, the data line driving circuit 12 is electrically connected to the control circuit 17 and is electrically connected to the pixel circuits 20 via the data lines X1 to Xm.

Specifically, as illustrated in FIG. 2, the data line driving circuit 12 has single-line driving circuits 12*a* of the number corresponding to that of the data lines X1 to Xm. Each of the respective single-line driving circuits 12*a* is electrically connected to the control circuit 17 and generates a data voltage Vdata for each of the pixel circuits 20 connected to the data lines X1 to Xm based on data line driving signals supplied from the control circuit 17. The respective single-line driving circuits 12*a* supply the generated data voltages Vdata to the pixel circuits 20 via the corresponding data lines X1 to Xm. Further, the single-line driving circuits 12*a* supply the driving voltages Vdd to the pixel circuits 20 via the data lines X1 to Xm.

When the internal state of a pixel circuit 20 is set in accordance with a data voltage Vdata, the pixel circuit 20 controls the value of a driving current Iel that flows through the organic EL element 21 in accordance with the internal state thereof. As a result, the brightness gray scales of the organic EL element 21 are controlled in accordance with the data voltage Vdata.

According to the present embodiment, as illustrated in FIG. 2, the data lines X1 to Xm are sequentially arranged in the order of a first data line X1, a second data line X2, . . . , and an mth data line Xm from the position in which the scanning line driving circuit 13 is provided.

As illustrated in FIG. 1, the scanning line driving circuit 13 is electrically connected to the control circuit 17. Further, the scanning line driving circuit 13 is electrically connected to the pixel circuits 20 via the scanning lines Y1 to Yn. The scanning line driving circuit 13 selects a group of pixel circuits of one row by selectively driving one among the plurality of scanning lines Y1 to Yn based on later-mentioned scanning control signals SC1 to SC3 supplied from the control circuit 17. According to the present embodiment, as illustrated in FIG. 2, the scanning lines Y1 to Yn are arranged in the order of a first scanning line Y1, a second scanning line Y2, . . . , and an nth scanning line Yn from the position opposite to the position in which the data line driving circuit 12 is provided to the position in which the data line driving circuit 12 is provided. According to the present embodiment, the scanning line driving circuit 13 is set so as to selectively drive the scanning lines Y1 to Yn in the order of the first scanning line Y1, the second scanning line Y2, the third scanning line Y3, . . . in accordance with the scanning control signals SC1 to SC3.

Further, the scanning lines Y1 to Yn consist of first sub-scanning lines Yn1, second sub-scanning lines Yn2, and third sub-scanning lines Yn3. The scanning line driving circuit 13 supplies first scanning signals SCn1 via the first sub-scanning lines Yn1 to the pixel circuits 20 connected to the first sub-scanning lines Yn1. Further, the scanning line driving circuit 13 supplies second scanning signals SCn2 via the second sub-scanning lines Yn2 to the pixel circuits 20 connected to the second sub-scanning lines Yn2. Moreover, the scanning line driving circuit 13 supplies third scanning signals SCn3 via the third sub-scanning lines Yn3 to the pixel circuits 20 connected to the third sub-scanning lines Yn3.

Specifically, when the data voltage Vdata is written in each of pixel circuits 20 connected to the nth scanning line Yn, the scanning line driving circuit 13 supplies H levels (high levels) of the first scanning signals SCn1 to the first sub-scanning lines Yn1 connected to the pixel circuits 20. When the written data voltage Vdata is erased (hereinafter, referred to as being reset), the scanning line driving circuit 13 supplies H levels (high levels) of the second scanning signals SCn2 to the second sub-scanning lines Yn2. When the amount of current in accordance with the written data voltage Vdata is supplied to the organic EL elements 21, the scanning line driving circuit 13 supplies H levels (high levels) of the third scanning signals SCn3 to the third sub-scanning lines Yn3. According to the present embodiment, the conductivity types of the transistors (switching transistors Qsw) connected to the first sub-scanning lines Yn1 are the n type as mentioned later. However, in cases where the conductivity types of the transistors connected to the first sub-scanning lines Yn1 are the p type, when the data voltage Vdata is written in each of the corresponding pixel circuits 20, L levels (low levels) of the first scanning signals SCn1 are supplied.

According to the present embodiment, the conductivity types of the transistors (reset transistors Qrst) connected to the second sub-scanning lines Yn2 are the n type as described in greater detail below. However, in cases where the conductivity types of the transistors connected to the second sub-scanning lines Yn2 are the p type, when the corresponding pixel circuits 20 are reset, L levels (low levels) of the second scanning signals SCn2 are supplied. Similarly, according to the present embodiment, the conductivity types of the transistors (start transistors Qst) connected to the third sub-scanning lines Yn3 are the n type as mentioned later. However, in cases where the conductivity types of the transistors connected to the third sub-scanning lines Yn3 are the p type, when the amount of current in accordance with the data voltage Vdata written in each of the corresponding pixel circuits 20 is supplied to the organic EL elements 21, L levels (low levels) of the third scanning signals SCn3 are supplied.

The memory circuit 14 stores display data representing the display state of the display panel 11 supplied from the computer 18, or various control programs. The oscillation circuit 15 supplies a reference operation signal to the other elements of the organic EL display 10. The power supply circuit 16 supplies a driving power source to the respective elements of the organic EL display 10.

The control circuit 17 controls the respective elements 11 to 16 generally. The control circuit 17 converts display data (image data) stored in the memory circuit 14 into matrix data representing gray scales of luminescence of the organic EL elements 21. The matrix data can include a scanning control signal for determining the first, second, and third scanning signals SCn1, SCn2, and SCn3 for sequentially selecting the group of pixel circuits of one row and a data line control signal for determining the level of data voltage Vdata supplied to each of the selected group of pixel circuits 20. The control circuit 17 supplies the scanning control signal to the scanning line driving circuit 13 and supplies the data line control signal to the data line driving circuit 12. The control circuit 17 controls the driving timing of the scanning lines Y1 to Yn and the data lines X1 to Xm in accordance with the reference operation signal supplied from the oscillation circuit 15.

Figure 3:
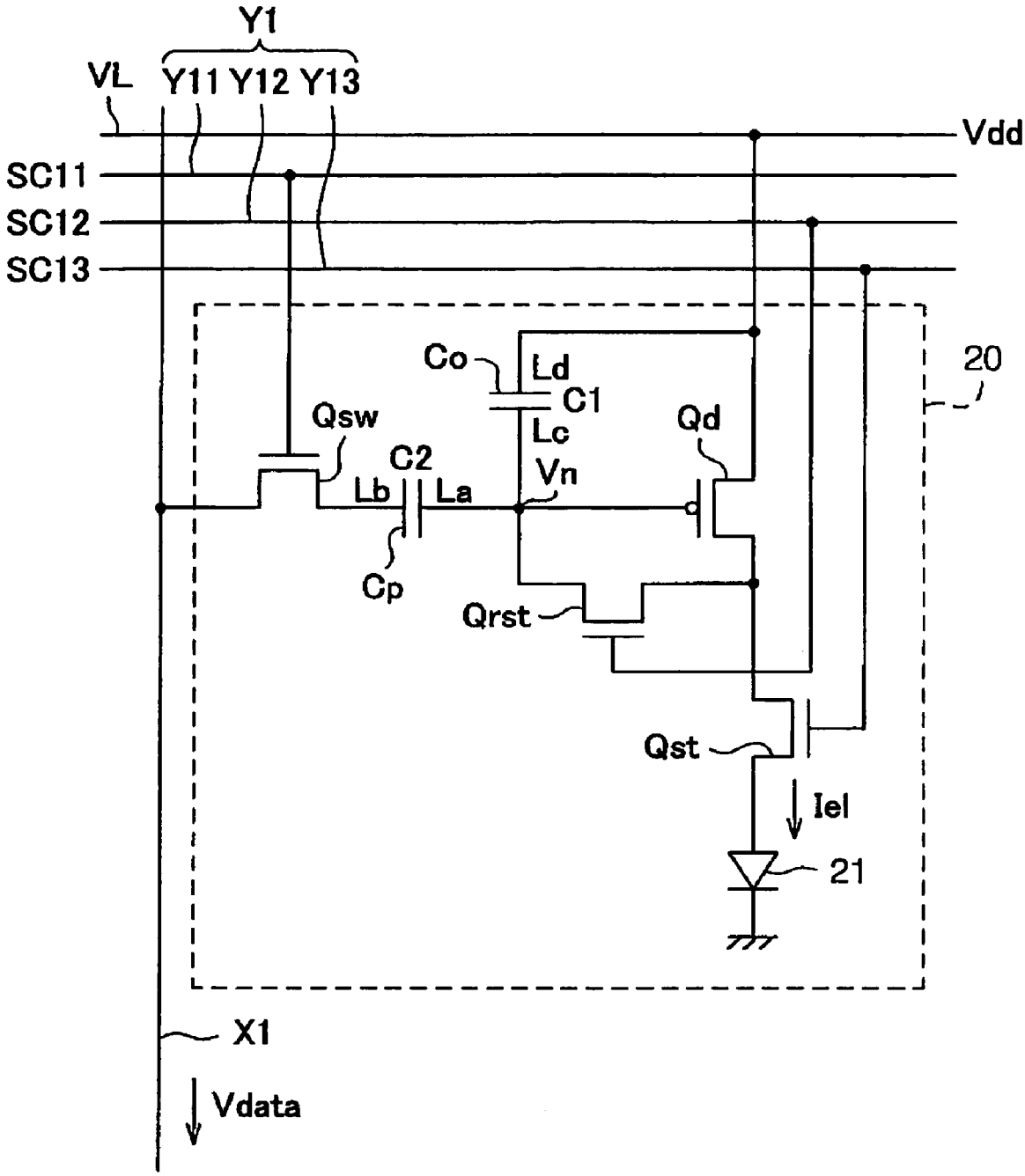
FIG. 3 is an exemplary circuit diagram of a pixel circuit according to the first embodiment.

Next, the internal structure of the pixel circuit 20 will be described with reference to FIG. 3. Since the structure of each of the pixel circuits 20 is the same, for the sake of convenience, a pixel circuit 20 arranged so as to correspond to the intersection between the first data line X1 and the first scanning line Y1 will now be described.

The pixel circuit 20 can include a driving transistor Qd, a start transistor Qst, a switching transistor Qsw, and a reset transistor Qrst. The pixel circuit 20 has a coupling capacitor Cp and a storage capacitor Co. The electrostatic capacity of the coupling capacitor Cp is C1 and the electrostatic capacity of the storage capacitor Co is C2.

The conductivity type of start transistor Qst, the switching transistor Qsw, and the reset transistor Qrst are the n type (the n channel). The conductivity type of the driving transistor Qd is the p type (the p channel). According to the present embodiment, the conductivity type of start transistor Qst, the switching transistor Qsw, and the reset transistor Qrst are the n type (the n channel) and the conductivity type of driving transistor Qd is the p type (the p channel). However, it should be understood that the present invention is not limited thereto. The conductivity types may be appropriately changed to the n type or the p type.

The driving transistor Qd is a transistor having a threshold voltage of Vth. The drain of the driving transistor Qd is connected to the drain of the start transistor Qst. The source of the start transistor Qst is connected to the anode of the organic EL element 21. The cathode of the organic EL element 21 is grounded. The gate of the start transistor Qst is connected to a third sub-scanning line Y13 that constitutes the first scanning line Y1.

The gate of the driving transistor Qd is connected to a first electrode La of the coupling capacitor Cp. The second electrode Lb of the coupling capacitor Cp is connected to the drain of the switching transistor Qsw. The source of the switching transistor Qsw is connected to the first data line X1. The gate of the switching transistor Qsw is connected to a first sub-scanning line Y11 that constitutes the first scanning line Y1. The gate of the driving transistor Qd is connected to a third electrode Lc of the storage capacitor Co. The electric potential of a fourth electrode Ld of the storage capacitor Co is set by the driving voltage Vdd.

The source of the driving transistor Qd is connected to the power line VL for supplying the driving voltage Vdd.

The reset transistor Qrst is connected between the gate and the drain of the driving transistor Qd. The gate of the reset transistor Qrst is connected to a second sub-scanning line Y12 that constitutes the first scanning line Y1. The reset transistor Qrst is switched on so that the drain of the driving transistor Qd is electrically connected to the gate of the driving transistor Qd. Therefore, the electric potential Vn of the gate of the driving transistor Qd is Vdd-Vth. Moreover, the first scanning line Y1 consists of the first, second, and third sub-scanning lines Y11, Y12, and Y13.

When the start transistor Qst is switched off and the reset transistor Qrst is switched on, the pixel circuit 20 having the above structure is reset since the electric potential Vn of the gate of the driving transistor Qd is forced to increase up to Vdd-Vth. As thus mentioned, the threshold voltage Vth of the driving transistor Qd is compensated for. The electric potential Vdd-Vth is stored in the storage capacitor Co as a first electric potential.

Further, the switching transistor Qsw is switched on so that the pixel circuit 20 stores the driving voltage Vdd supplied from the data line driving circuit 12 in the storage capacitor Co and the coupling capacitor Cp. The switching transistor Qsw is switched off after the data voltage Vdata is supplied so that the pixel circuit 20 couples the coupling capacitor Cp and the storage capacitor Co capacitively. As a result, the electric potential in accordance with the capacitive coupling is stored in the storage capacitor Co as a second electric potential. When the start transistor Qst is switched on in such as state, the driving current Iel in accordance with the second electric potential stored in the storage capacitor Co is supplied to the organic EL element 21. As a result, the organic EL element 21 can emit light in accordance with the data voltage Vdata.

According to the present embodiment, the conductive types of the switching transistor Qsw, the start transistor Qst, the driving transistor Qd, and the reset transistor Qrst are the n type and the conductive type of driving transistor Qd is the p type. However, it should be understood that the present invention is not limited thereto, and that appropriate changes may be made.

According to the present embodiment, the electro-optical device and the controlling terminal, for example, correspond to the organic EL element and the gate of the driving transistor Qd. According to the present embodiment, the capacitor element, for example, corresponds to the storage capacitor C1. According to the embodiment, the selection signals, for example, correspond to the first, second, and third scanning signals SCn1, SCn2, and SCn3.

Next, the operation of the organic EL display 10 having the above structure will now be described with reference to the operation of selecting the scanning lines Y1 to Yn of the scanning line driving circuit 13 based on the control circuit 17. For the simplification of description, the organic EL display 10 consisting of seven scanning lines Y1 to Y7 will now be taken as an example.

Figure 4:
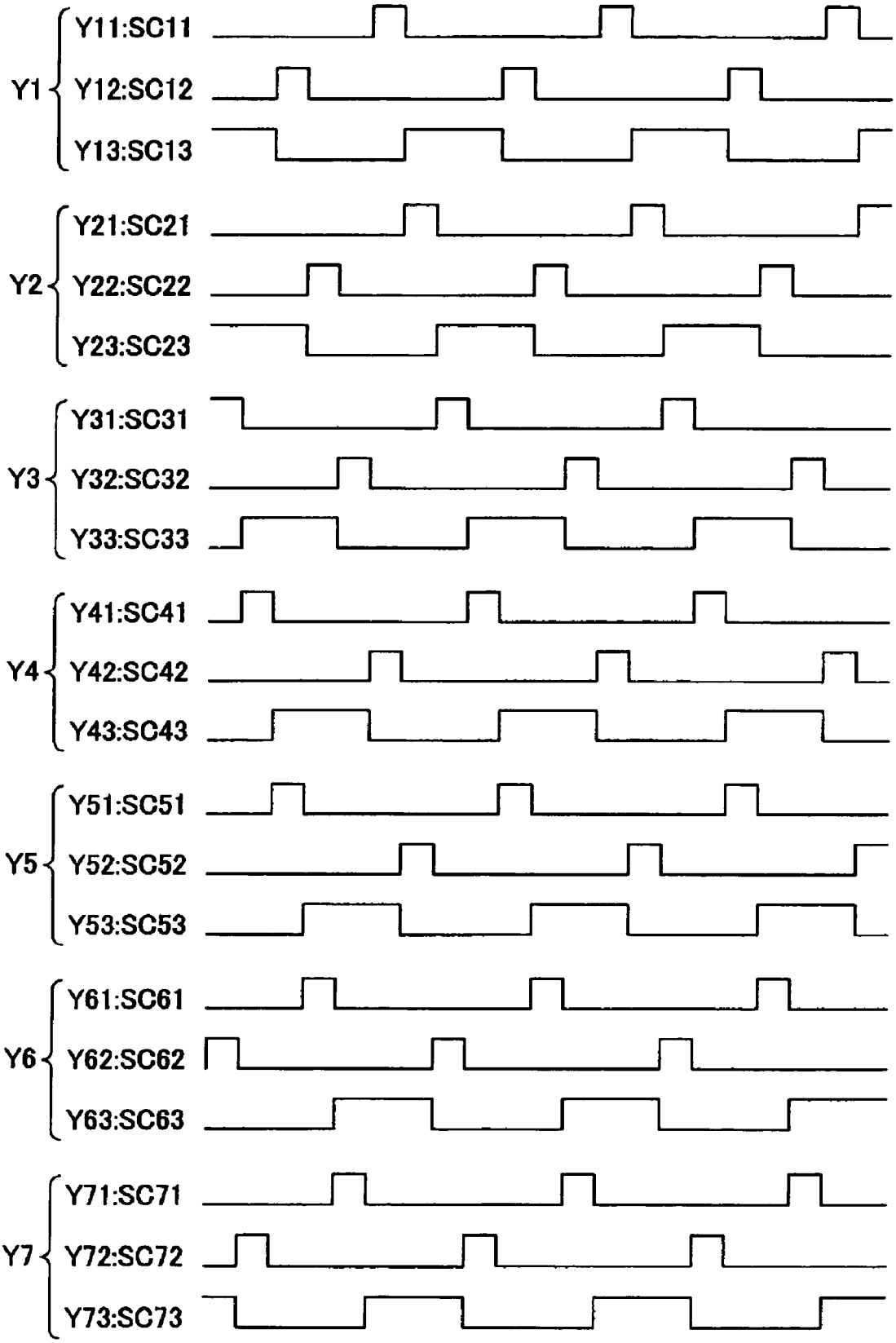
FIG. 4 is a timing chart for illustrating the operation of the pixel circuit according to the first embodiment.

FIG. 4 is a timing chart for explaining a method of driving the organic EL display 10 that consists of the seven scanning lines Y1 to Y7. Moreover, the scanning line driving circuit 13 is preset so as to selectively control the scanning lines in the order of the first scanning line Y1→the second scanning line Y2→the third scanning line Y3→the fourth scanning line Y4→the fifth scanning line Y5→the sixth scanning line Y6→the seventh scanning line Y7 in a main period of time (one-frame period of time) as mentioned above.

First, the scanning line driving circuit 13 selectively drives the second sub-scanning lines Y12 to Y72 of the first to seventh scanning lines Y1 to Y7 in the order of the first scanning line Y1→the second scanning line Y2→the third scanning line Y3→the fourth scanning line Y4→the fifth scanning line Y5→the sixth scanning line Y6→the seventh scanning line Y7. That is, the scanning line driving circuit 13 supplies the second scanning signal SC2, which switches on the reset transistors Qrst, to the sub-scanning lines of the scanning lines in the order of the second sub-scanning line Y12 of the first scanning line Y1→the second sub-scanning line Y22 of the second scanning line Y2 → . . . → the second sub-scanning line Y72 of the seventh scanning line Y7. As thus mentioned, the pixel circuits 20 are sequentially reset from each of the group of pixel circuits 20 connected to the first scanning line Y1 (first step).

Thereafter, the scanning line driving circuit 13 supplies the second scanning signal SC2, which switches off the reset transistors Qrst, to the sub-scanning lines of the scanning lines in the order of the second sub-scanning line Y12 of the first scanning line Y1→the second sub-scanning line Y22 of the second scanning line Y2 → . . . →the second sub-scanning line Y72 of the seventh scanning line Y7. As thus mentioned, the resetting of the pixel circuits 20 is sequentially stopped from each of the group of pixel circuits 20 connected to the first scanning line Y1 (second step).

Further, the scanning line driving circuit 13 supplies the second scanning signal SC2, which switches on the reset transistors Qrst, to the second sub-scanning line Y42 of the fourth scanning line Y4, and supplies the first scanning signal SC1, which switches on the switching transistors Qsw, to the first sub-scanning line Y11 of the first scanning line Y1 (second step).

Thereafter, the scanning line driving circuit 13 sequentially supplies the second scanning signal SC2, which switches on the reset transistors Qrst, to the second sub-scanning line Y52 of the fifth scanning line Y5, the second sub-scanning line Y62 of the sixth scanning line Y6, . . . , and simultaneously supplies the first scanning signals SC 11 to SC73, which switch on the switching transistors Qsw, to the first sub-scanning line Y21 of the second scanning line Y2, the second sub-scanning line Y32 of the third scanning line Y3, . . . . Therefore, the data voltages Vdata are sequentially written in the pixel circuits 20 after the resetting is stopped.

Then, the scanning line driving circuit 13 sequentially supplies the third scanning signals SC13 to SC73, which switch on the start transistors Qst of the pixel circuits 20, to the pixel circuits 20 from the pixel circuit 20 in which the writing is stopped via the corresponding third sub-scanning lines Y13 to Y73. As a result, the organic EL elements 21 sequentially arranged in the pixel circuits 20 from the pixel circuit 20 to which the data voltage Vdata is supplied emit light in accordance with the data voltage Vdata. As a result, an image of one frame is displayed.

Thereafter, the scanning line driving circuit 13 sequentially supplies the third scanning signals SCn3 which switch off the start transistors Qst, and the second scanning signals SC12 to SC72, which switch on the reset transistors Qrst, to the scanning lines from the pixel circuit 20 that includes the organic EL element 21 that emits light in a predetermined period of time (third step).

As a result, it is possible to stop the luminescence of the organic EL elements 21 in the order of each of the organic EL elements 21 of the group of pixel circuits 20 connected to the first scanning line Y1, each of the organic EL elements 21 of the group of pixel circuits 20 connected to the second scanning line Y2, . . . , and to reset the pixel circuits 20 while compensating for the threshold voltages Vth of the driving transistors Qd of the pixel circuits 20.

Therefore, the organic EL display 10 according to the present invention can control the luminescence period of the organic EL element 21 by controlling the timing of supplying the second scanning signals SC12 to SC72, which switch on the reset transistors Qrst. Further, the driving current Iel is supplied to the gate of the driving transistor Qd by connecting the reset transistor Qrst between the drain and the gate of the driving transistor Qd of each of the pixel circuits 20 and by switching on the reset transistors Qrst when the pixel circuits 20 are reset. As a result, the electric potential Vn of the gate of the driving transistor Qd is forced to increase thereby resetting the pixel circuits 20. Therefore, it is possible to reset the pixel circuits 20 without providing special circuits. As a result, it is possible to provide the organic EL display 10 with a high quality of display, thereby reducing the manufacturing cost thereof.

According to the organic EL display 10 and the pixel circuits 20 of the above embodiment, it is possible to obtain the following characteristics.

(1) In the above embodiment, the pixel circuit 20 consists of the driving transistor Qd, the start transistor Qst, the switching transistor Qsw, the reset transistor Qrst, the coupling capacitor Cp, and the storage capacitor Co. The reset transistor Qrst is switched on in accordance with the second scanning signal SCn2 supplied from the scanning line driving circuit so as to electrically connect the drain and the gate of the driving transistor Qd to each other.

The scanning line driving circuit 13 selectively controls the scanning lines in the order of the first scanning line Y1→the second scanning line Y2→the third scanning line Y3→the fourth scanning line Y4→the fifth scanning line Y5→the sixth scanning line Y6→the seventh scanning line Y7→the first scanning line Y1. After letting the organic EL elements 21 of the pixel circuits 20 connected to the first scanning line Y1 sequentially emit light, the reset transistors Qrst are switched on.

Therefore, it is possible to reset the pixel circuits 20 in the order of the first scanning line Y1→the second scanning line Y2→the third scanning line Y3→the fourth scanning line Y4→the fifth scanning line Y5→the sixth scanning line Y6→the seventh scanning line Y7→the first scanning line Y1 while compensating for the threshold voltages Vth of the driving transistors Qd. As a result, the organic EL display 10 according to the present invention can sequentially reset the pixel circuits 20 without providing special circuits.

A second embodiment according to the present invention will be described with reference to FIGS. 5 and 6. According to the present embodiment, the same elements as those of the first embodiment are denoted by the same reference numerals and detailed description thereof will be omitted.

Figure 5:
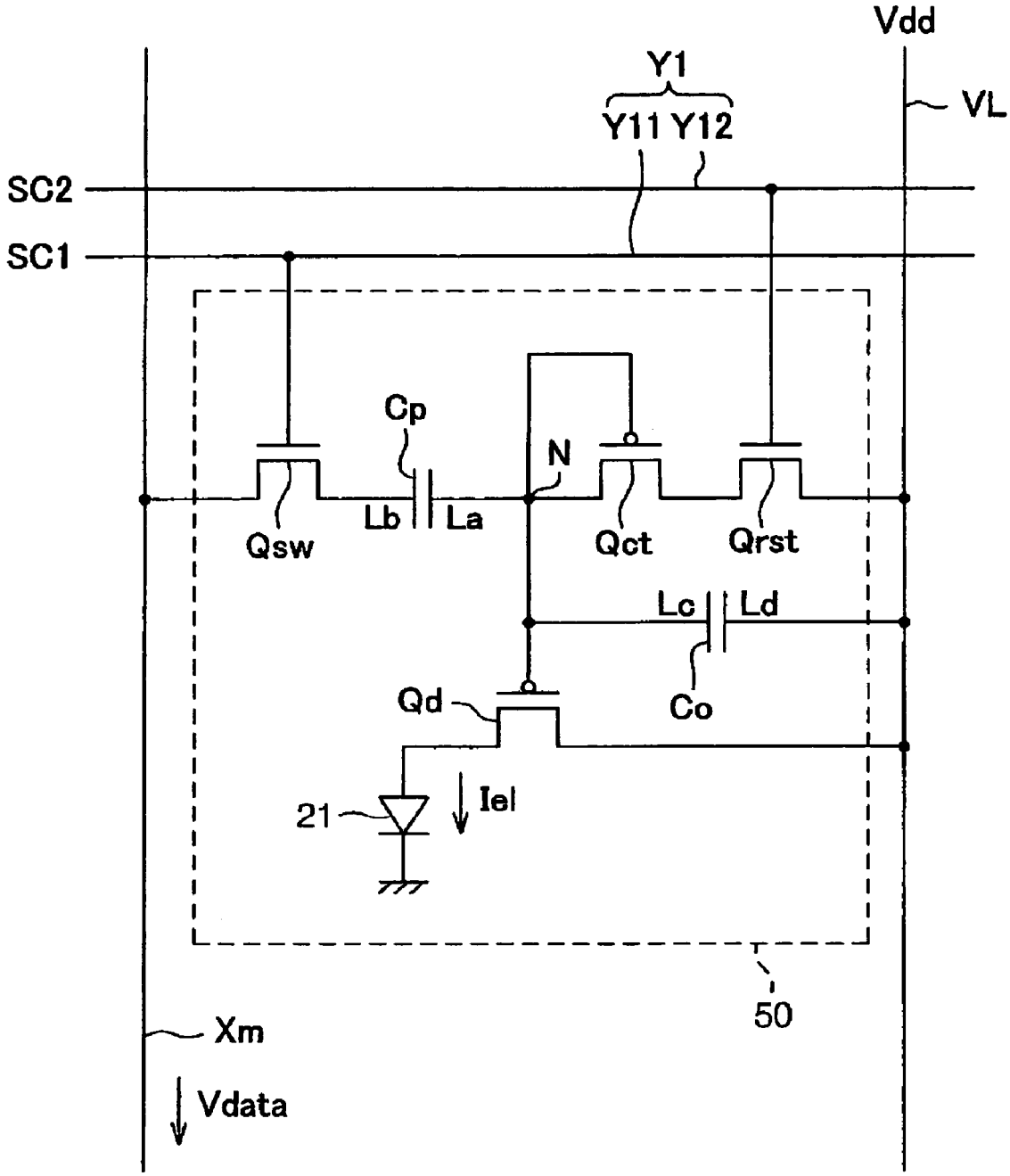
FIG. 5 is an exemplary circuit diagram of a pixel circuit according to a second embodiment.

FIG. 5 is an exemplary circuit diagram of a pixel circuit 50 provided in the display panel 11 of the organic EL display 10. FIG. 6 is a timing chart illustrating the operation of the pixel circuit 50.

According to the present embodiment, the power lines VL are parallel to the data lines X1 to Xm. According to the present embodiment, each of the scanning lines Y1 to Yn consists of the first sub-scanning line Yn1 and the second sub-scanning line Yn2.

As illustrated in FIG. 5, the pixel circuit 50 includes the driving transistor Qd, a controlling transistor Qct, the switching transistor Qsw, and the reset transistor Qrst. The pixel circuit 50 includes the storage capacitor Co and the coupling capacitor Cp.

The conductivity types of the driving transistor Qd and the controlling transistor Qct are the p type (the p channel). The conductivity types of the switching transistor Qsw and the reset transistor Qrst are the n type (the n channel).

According to the second embodiment, the drain of the driving transistor Qd is connected to the anode of the organic EL element 21. The cathode of the organic EL element 21 is grounded. The source of the driving transistor Qd is connected to the power line VL. The gate of the driving transistor Qd is electrically connected to the coupling capacitor Cp, the storage capacitor Co, and the controlling transistor Qct.

Specifically, the gate of the driving transistor Qd is connected to the first electrode La of the coupling capacitor Cp. The second electrode Lb of the coupling capacitor Cp is connected to the drain of the switching transistor Qsw. The gate of the switching transistor Qsw is connected to the first sub-scanning line Y11 that constitutes the first scanning line Y1.

The gate of the driving transistor Qd is connected to the third electrode Lc of the storage capacitor Co. The fourth electrode Ld of the storage capacitor Co is connected to the power line VL. The gate of the driving transistor Qd is connected to the drain of the controlling transistor Qct. The drain of the controlling transistor Qct is connected to the gate of the controlling transistor Qct in a node N. The source of the controlling transistor Qct is connected to the source of the reset transistor Qrst. The drain of the reset transistor Qrst is connected to the power line VL. The gate of the reset transistor Qrst is connected to the second sub-scanning line Y12 that constitutes the first scanning line Y1.

The controlling transistor Qct is set so that the threshold voltage Vthct thereof is equal to the threshold voltage Vth of the driving transistor Qd. According to the present embodiment, since the reset transistor Qrst is switched on when the switching transistor Qsw is switched off, the electric potential Vn in the node n is Vdd−Vthct. The electric potential Vn is stored in the storage capacitor Co as an initial electric potential Vc1. As mentioned above, the threshold voltage Vthct of the controlling transistor Qct is previously set so as to be equal to the threshold voltage Vth of the driving transistor Qd. Accordingly, the reset transistor Qrst is switched on so that the pixel circuit 20 can be reset while compensating for the threshold voltage Vth of the driving transistor, Qd.

The threshold voltage Vthct of the controlling transistor Qct may be appropriately set in accordance with the driving condition of the controlling transistor Qct. The driving voltage Vdd is previously set so as to be much higher than the data voltage Vdata.

Further, in the second embodiment, for example, the first transistor, a first terminal, a second terminal, and a first controlling terminal correspond to the driving transistor Qd, the drain of the driving transistor Qd, the source of the driving transistor Qd, and the gate of the driving transistor Qd, respectively. Moreover, in the second embodiment, for example, the second transistor, a third terminal, a fourth terminal, and a second controlling terminal correspond to the controlling transistor Qct, the drain of the controlling transistor Qct, the source of the controlling transistor Qct, and the gate of the controlling transistor Qct, respectively.

Next, the operation of the organic EL display 10 having the pixel circuit 50 will be described with reference to the operation of selecting the scanning lines Y1 to Yn of the scanning line driving circuit 13 based on the controlling circuit 17. For the simplification of description, the organic EL display 10 that consists of the five scanning lines Y1 to Y5 will be taken as an example.

Figure 6:
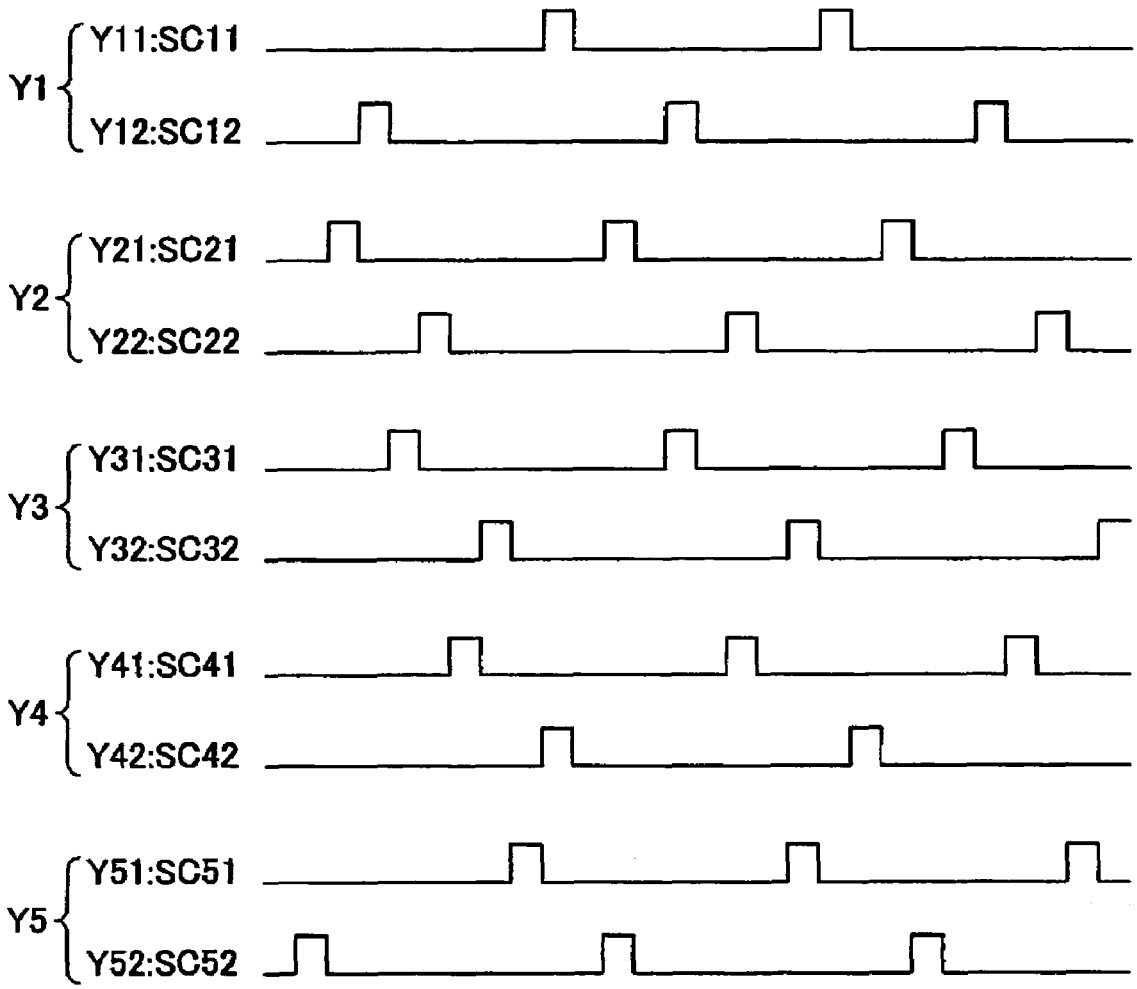
FIG. 6 is a timing chart for illustrating the operation of the pixel circuit according to the second embodiment.

FIG. 6 is a timing chart for illustrating a method of driving the organic EL display 10 that consists of the five scanning lines Y1 to Y5. Further, the scanning line driving circuit 13 is preset so as to selectively control the scanning lines in the order of the first scanning line Y1→the second scanning line Y2→the third scanning line Y3→the fourth scanning line Y4→the fifth scanning line Y5→the first scanning line Y1 in one-frame period of time.

First, the scanning line driving circuit 13 selectively drives the second sub-scanning lines Y12 to Y52 of the first to fifth scanning lines Y1 to Y5 in the order of the first scanning line Y1→the second scanning line Y2→the third scanning line Y3→the fourth scanning line Y4→the fifth scanning line Y5. The scanning line driving circuit 13 supplies the second scanning signal SC2, which switches on the reset transistors Qrst, to the sub-scanning lines of the scanning lines in the order of the second sub-scanning line Y12 of the first scanning line Y1→the second sub-scanning line Y22 of the second scanning line Y2→ . . . → the second sub-scanning line Y52 of the fifth scanning line Y5 (first step).

As a result, the electric potentials Vn in the nodes n of the pixel circuits 50 sequentially become Vn=Vdd−Vthct from the pixel circuits 50 connected to the first scanning line Y1. The electric potential Vn is stored in the storage capacitor Co as an initial electric potential Vc1, and the initial electric potential Vc1 is supplied to the gate of the driving transistor Qd. As mentioned above, since the threshold voltage Vthct of the controlling transistor Qct is equal to the threshold voltage Vth of the driving transistor Qd, the threshold voltage Vth of the driving transistor Qd is compensated for. As thus mentioned, the pixel circuits 50 are sequentially reset from each of the group of pixel circuits 50 connected to the first scanning lines Y1.

Thereafter, the scanning line driving circuit 13 supplies the second scanning signal SC2, which switches off the reset transistors Qrst, to the sub-scanning lines of the scanning lines in the order of the second sub-scanning line Y12 of the first scanning line Y1→the second sub-scanning line Y22 of the second scanning line Y2→ . . . → the second sub-scanning line Y52 of the fifth scanning line Y5.

Then, the scanning line driving circuit 13 supplies the second scanning signal SC2, which switches on the reset transistors Qrst, to the second sub-scanning line Y42 of the fourth scanning line Y4, and simultaneously supplies the first scanning signal SC1, which switches on the switching transistors Qsw, to the first sub-scanning line Y11 of the first scanning line Y1, to supply the data voltages Vdata to the corresponding circuits 20 (second step).

Thereafter, the scanning line driving circuit 13 sequentially supplies the second scanning signal SC2, which switches on the reset transistors Qrst, to the second sub-scanning line Y52 of the fifth scanning line Y5, the second sub-scanning line Y12 of the first scanning line Y1, . . . and supplies the first scanning signal SC1, which switches on the switching transistors Qsw, to the first sub-scanning line Y21 of the second scanning line Y2, the second sub-scanning line Y32 of the third scanning line Y3, . . . , As thus described, after stopping resetting the pixel circuits 50, the data voltages Vdata are sequentially written.

Then, the scanning line driving circuit 13 sequentially supplies the second scanning signal SC2, which switches off the switching transistors Qsw, to the pixel circuits 50 from the pixel circuit 50 in which the resetting is stopped via the corresponding second sub-scanning lines Y12 to Y52 (third step).

As a result, the organic EL elements 21 arranged in the pixel circuits 50 emit light in accordance with the data voltages Vdata in the order of the first scanning line Y1→the second scanning line Y2→the third scanning line Y3→the fourth scanning line Y4→the fifth scanning line Y5→the sixth scanning line Y6→the seventh scanning line Y7. As a result, an image of one frame is displayed.

Thereafter, the scanning line driving circuit 13 sequentially supplies the third scanning signal SCn3, which switches on the reset transistors Qrst again, to the scanning lines in the order of the first scanning line Y1→the second scanning line Y2→the third scanning line Y3→the fourth scanning line Y4→the fifth scanning line Y5. As a result, it is possible to stop the luminescence of the organic EL elements 21 in the order of each of the organic EL elements 21 of the group of the pixel circuits 50 connected to the first scanning line Y1, each of the organic EL elements 21 of the group of the pixel circuits 50 connected to the second scanning line Y2, . . . , and to reset the pixel circuits 50 while compensating for the threshold voltages Vth of the driving transistors Qd of the pixel circuits 50.

Accordingly, the organic EL display 10 having the pixel circuits 50 sequentially resets the pixel circuits 50 by sequentially supplying the second scanning signal SCn2, which switches on the reset transistors Qrst, to the sub-scanning lines of the scanning lines via the second sub-scanning line Yn2 that constitutes the corresponding scanning line Yn. As a result, it is possible to reset the pixel circuits 50 without providing special circuits.

Next, an application of the organic EL display 10 as an electro-optical device described in the first and second embodiments to an electronic apparatus will be described with reference to FIG. 7. The organic EL display 10 can be applied to various electronic apparatuses such as mobile personal computers, mobile telephones, and digital cameras.

Figure 7:
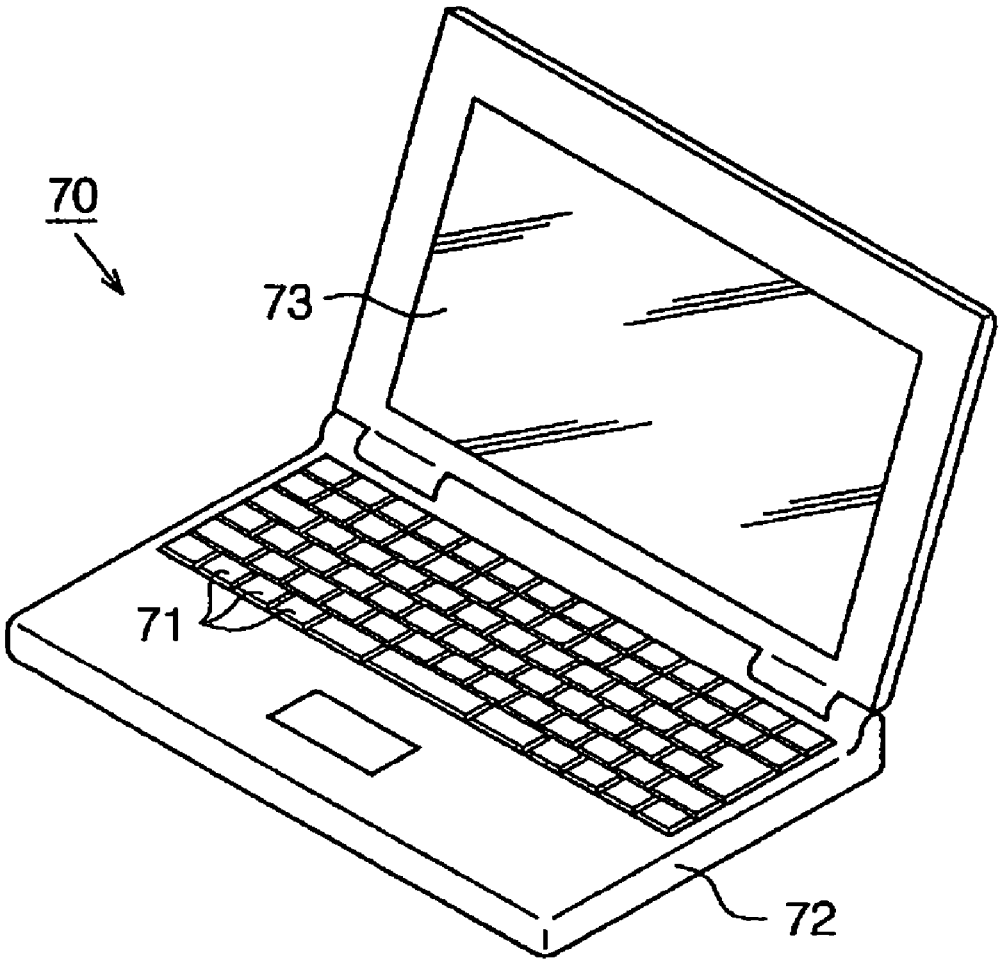
FIG. 7 is a perspective view illustrating the structure of a mobile personal computer for illustrating a third embodiment.

FIG. 7 is a perspective view illustrating the structure of a mobile personal computer. In FIG. 7, the personal computer 70 includes a main body 72 including a keyboard 71 and a display unit 73 using the organic EL display 10. In this case, the display unit 73 using the organic EL display 10 also has the same effect as those of the first and second embodiments. As a result, it is possible to reduce the writing time of the mobile personal computer 70.

Further, it should be understood that the embodiments of the present invention are not limited to the above and the following modifications can be made.

Figure 8:
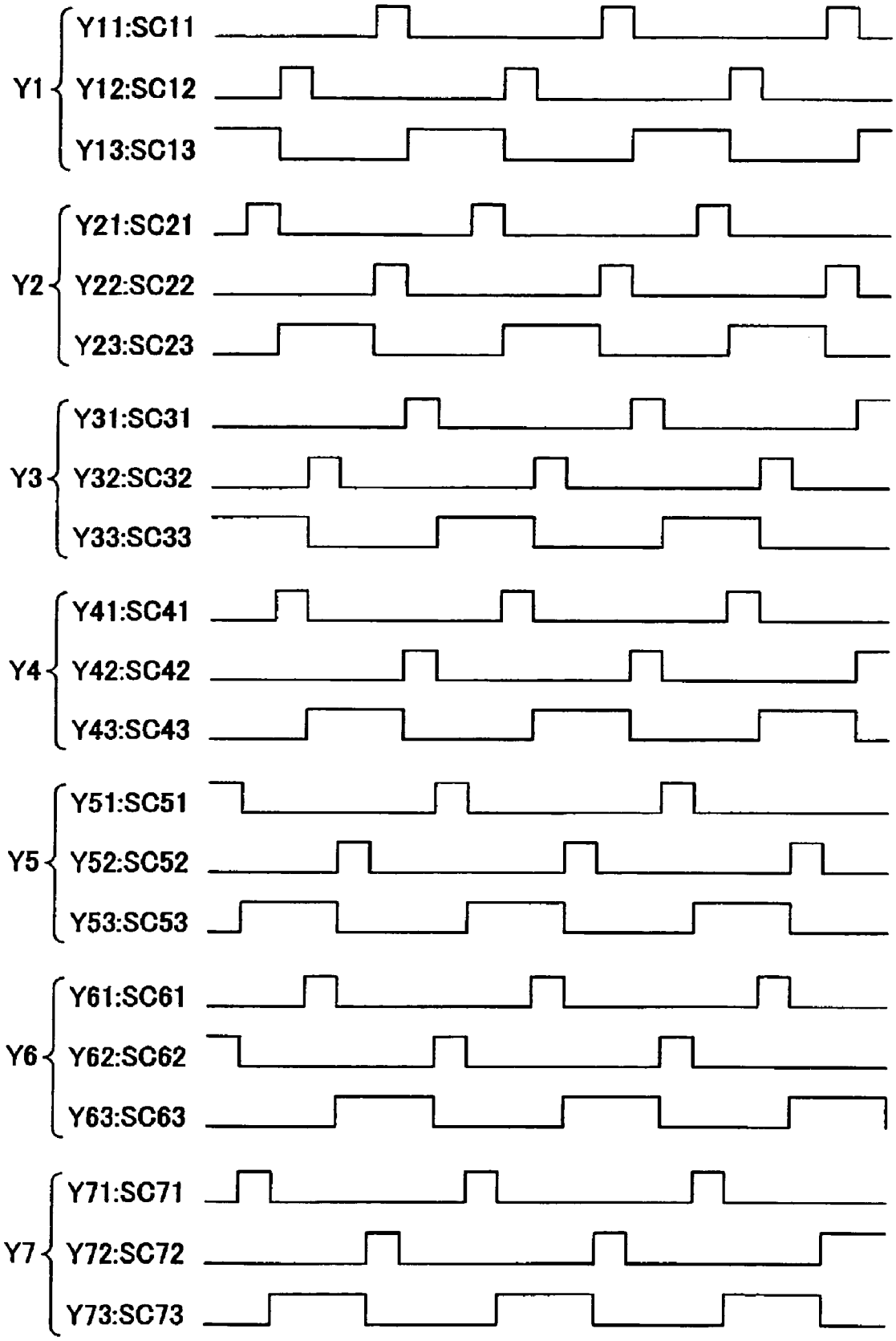
FIG. 8 is a timing chart of a pixel circuit for illustrating a modification.

According to the first embodiment, the scanning line driving circuit 13 supplies the second scanning signal SCn2, which switches on the reset transistors Qrst, to the scanning lines in the order of the first scanning line Y1→the second scanning line Y2→the third scanning line Y3→the fourth scanning line Y4→the fifth scanning line Y5→the sixth scanning line Y6→the seventh scanning line Y7. After the pixel circuits 20 are reset, the data voltages Vdata are sequentially supplied. As illustrated in FIG. 8, the scanning line driving circuit 13 may supply the second scanning signals SCn2, which switch on the reset transistors Qrst, to the scanning lines in the order of the first scanning line Y1→ the third scanning line Y3→the second scanning line Y2→the fourth scanning line Y4→the sixth scanning line Y6→the fifth scanning line Y5→the seventh scanning line Y7. That is, the organic EL display 10 may be controlled using the transfer scanning method by preventing a selected scanning line from being adjacent to a next selected scanning line. Therefore, it is possible to obtain the same effect as that of the first embodiment.

According to the first embodiment, in the organic EL display 10 including the scanning lines Y1 to Y7, the scanning line driving circuit 13 vertically scans the scanning lines in the order of the first scanning line Y1→the second scanning line Y2→the third scanning line Y3→the fourth scanning line Y4→the fifth scanning line Y5→the sixth scanning line Y6→the seventh scanning line Y7 in the main period of time (a one-frame period of time), resets the pixel circuits 20, and writes the data voltages Vdata in the pixel circuits 20. The scanning line driving circuit 13 may provide two sub-periods of time in the main period of time (the one-frame period of time), and may vertically scan the scanning lines in the sub-periods of time.

In the first sub-period of time, the scanning line driving circuit 13 may select the scanning lines in odd rows in the order of the first scanning line Y1→the third scanning line Y3→the fifth scanning line Y5→he seventh scanning line Y7, reset the pixel circuits 20, and write the data voltages Vdata in the pixel circuits 20. In the second sub-period of time, the scanning line driving circuit 13 may select the scanning lines in even rows in the order of the second scanning line Y2→the fourth scanning line Y4→the sixth scanning line Y6, reset the pixel circuits 20, and write the data voltages Vdata in the pixel circuits 20. That is, the organic EL display 10 may be controlled using the interlace scanning method. Therefore, in addition to the effect of the first embodiment, it is possible to let each scanning line reset the pixel circuits and control the writing of data, thereby reducing the burden of the scanning line driving circuit 13.

Figure 9:
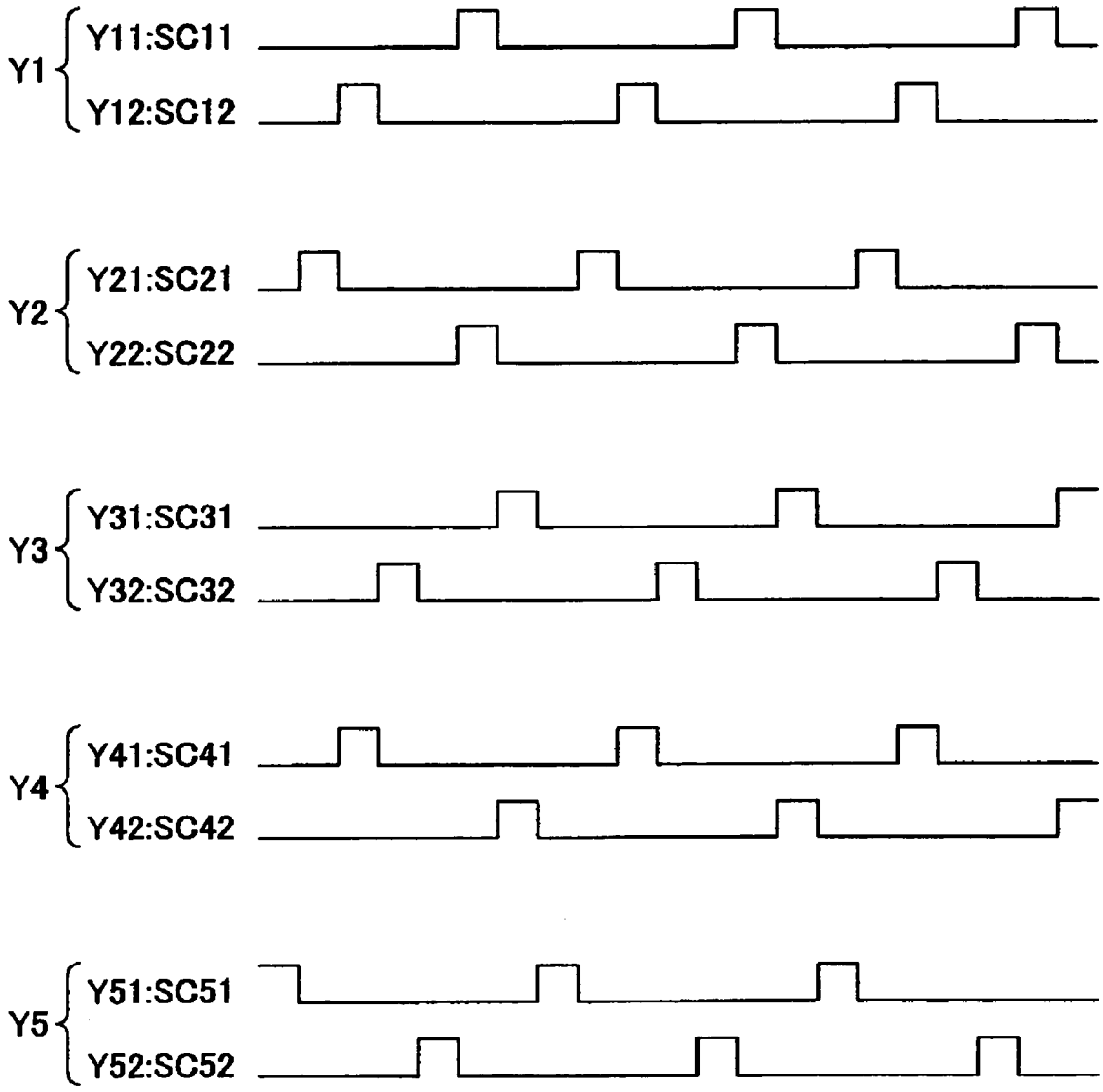
FIG. 9 is a timing chart of a pixel circuit for illustrating another modification.

According to the second embodiment, in the organic EL display 10 including the scanning lines Y1 to Y5, the scanning line driving circuit 13 supplies the second scanning signals SCn2 that switch the reset transistors Qrst to the on state to the scanning lines in the order of the first scanning line Y1→the second scanning line Y2→the third scanning line Y3→the fourth scanning line Y4→the fifth scanning line Y5→the first scanning line Y1. As illustrated in FIG. 9, the scanning line driving circuit 13 may supply the second scanning signals SCn2 that switch the reset transistors Qrst to the on state to the scanning lines in the order of the first scanning line Y1→the third scanning line Y3→the second scanning line Y2→the fourth scanning line Y4→the first scanning line Y1→the fifth scanning line Y5. That is, the organic EL display 10 may be controlled using the transfer scanning method by preventing a selected scanning line from being adjacent to a next selected scanning line. Therefore, it is possible to obtain the same effect as that of the second embodiment.

According to the first embodiment, in the organic EL display 10 including the scanning lines Y1 to Y5, the scanning line driving circuit 13 vertically scans the scanning lines in the order of the first scanning line Y1→the second scanning line Y2→the third scanning line Y3→the fourth scanning line Y4→the fifth scanning line Y5 in the main period of time (the one-frame period of time), resets the pixel circuits 50, and writes the data voltages Vdata in the pixel circuits 50. The scanning line driving circuit 13 may provide two sub-periods of time in the main period of time (the one-frame period of time) and may vertically scan the scanning lines in the sub-periods of time. In the first sub-period of time, the scanning line driving circuit 13 may select the scanning lines in odd rows in the order of the first scanning line Y1→the third scanning line Y3→the fifth scanning line Y5, reset the pixel circuits 50, and write the data voltages Vdata in the pixel circuits 50. In the second sub-period of time, the scanning line driving circuit 13 may select the scanning lines in even rows in the order of the second scanning line Y2→the fourth scanning line Y4, reset the pixel circuits 50, and write the data voltages Vdata in the pixel circuits 50. That is, the organic EL display 10 may be controlled using the interlace scanning method. Therefore, in addition to the effect of the second embodiment, it is possible to let each scanning line reset the pixel circuits and control the writing of data, thereby reducing the burden of the scanning line driving circuit 13.

According to the first embodiment, the fourth electrode Ld of the storage capacitor Co is connected to the source of the driving transistor Qd; however, it may be directly connected to the power lines VL. Therefore, it is possible to obtain the same effects as those of the first and second embodiments.

According to the first and second embodiments, pixel circuits are embodied in the pixel circuits 20 and 50 thereby obtaining appropriate effects; however, they may be embodied in the pixel circuits for driving current driving elements such as luminous elements, for example, light emission diodes (LED) and field emission diodes (FED) other than organic EL elements 21. Pixel circuits may be embodied in memory devices such as random access memories (RAM).

According to the first and second embodiments, the current driving elements of the pixel circuits 20 and 50 are embodied in the organic EL elements 21; however, they may be embodied in inorganic EL elements. That is, the above embodiments may be applied to an inorganic EL display comprising the inorganic EL elements.

According to the first and second embodiments, the organic EL display 10 in which pixel circuits 20 of the organic EL elements 21 of one color are provided is used. However, the above embodiments may be applied to an EL display in which the pixel circuits 20 and 50 for red, green, and blue colors, which correspond to the organic EL elements 21 of red, green, and blue colors, are provided.

Thus, while this invention has been described in conjunction with specific embodiments thereof, it is evident that many alternatives, modifications, and variations will be apparent to those skilled in the art. Accordingly, preferred embodiments of the invention as set forth herein are intended to be illustrative not limiting. Various changes may be made without departing from the spirit and scope of the invention.

What is claimed is:

1. A method of driving electro-optical device having scanning lines, data lines, power lines and pixel circuits each of which includes an electro-scanning optical element and a driving transistor, the method comprising:

setting a potential of a controlling terminal of the driving transistor to a first voltage level, the setting of the potential of the controlling terminal to the first voltage level including electrically connecting one of a source and a drain to the controlling terminal during a first period;

setting the potential of the controlling terminal to a second voltage level by a capacitive coupling occurring at a capacitive element connected to the controlling terminal, the setting of the potential of the controlling terminal to the second voltage level including applying a data voltage to the capacitive element through one data line of the data lines and a switching transistor; and supplying a driving current or driving voltage to the electro-optical element during a second period, the source and the drain being electrically disconnected from the controlling terminal of the driving transistor during at least part of the second period, the driving current or the driving voltage having a level corresponding to a conduction state of the driving transistor during a second period, the electro-optical element being electrically connected to one power line of the power lines during a second period in which the supplying of the driving current or the driving voltage to the electro-optical element is carried out.

2. An electro-optical device using the method according to claim 1.

3. The electro-optical device according to claim 2, each of the power lines being disposed along a direction along which each of scanning lines extends.

4. The electro-optical device according to claim 2, the power lines intersecting the data lines.

5. A method of driving an electro-optical device having scanning lines, data lines, and pixel circuits each of which includes an electro-optical element and a driving transistor, the method comprising:

setting a potential of a controlling terminal of the driving transistor to a first voltage level, the setting of the potential of the controlling terminal to the first voltage level including electrically connecting one of a source and a drain to the controlling terminal during a first period;

setting the potential of the controlling terminal to a second voltage level by using a capacitive coupling occurring at a capacitive element connected to the controlling terminal, the setting of the potential of the controlling terminal to the second voltage level including applying a data voltage to the capacitive element through one data line of the data lines and a switching transistor; and supplying a driving current or a driving voltage to the electro-optical element during a second period, the source and the drain being electrically disconnected from the controlling terminal of the driving transistor during at least part of the second period, the driving current or the driving voltage having a level corresponding to a conduction state of the driving transistor.

6. The method according to claim 5, the first voltage level being a voltage level the driving transistor in an off-state.

7. The method according to claim 5, the pixel circuits including a plurality of group of pixel circuits each of which is disposed along one scanning line of the scanning lines, and each of the plurality of groups of pixel circuits including electro-optical elements for an identical color.

8. The method according to claim 7, each of the plurality of groups of pixel circuits including electro-optical elements that emit an identical color.

9. The method according to claim 5, the electro-optical element being EL element.

10. An electronic apparatus using the method of driving the electro-optical device according to claim 5.

11. The method according to claim 5, the switching transistor being included in each of the pixel circuits.

12. The method according to claim 5, the electro-optical device further including power lines each of which disposed along a direction along which each of scanning lines extends.

13. The method according to claim 12, the electro-optical element being electrically connected to one power line of the power lines through the driving transistor during the second period in which the supplying of the driving current or the driving voltage to the electro-optical element is carried out.

14. The method according to claim 5, the conduction state of the driving transistor being set according to the second voltage level.

15. The method according to claim 5, the electro-optical device further including power lines intersecting the data lines.

* * * * *